US009659533B2

(12) United States Patent
Kurita

(10) Patent No.: US 9,659,533 B2
(45) Date of Patent: May 23, 2017

(54) DISPLAY APPARATUS AND CONTROL METHOD THEREOF

(71) Applicant: CANON KABUSHIKI KAISHA, Tokyo (JP)

(72) Inventor: Masanao Kurita, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 14/674,758

(22) Filed: Mar. 31, 2015

(65) Prior Publication Data

US 2015/0279326 A1 Oct. 1, 2015

(30) Foreign Application Priority Data

Apr. 1, 2014 (JP) ..... 2014-075651

(51) Int. Cl.
*G09G 5/02* (2006.01)
*G09G 3/34* (2006.01)

(52) U.S. Cl.
CPC ..... *G09G 3/3426* (2013.01); *G09G 3/3413* (2013.01); *G09G 2320/0242* (2013.01); *G09G 2320/048* (2013.01); *G09G 2360/145* (2013.01)

(58) Field of Classification Search
CPC ..... G09G 3/3406–3/3426
See application file for complete search history.

(56) References Cited

U.S. PATENT DOCUMENTS 6,188,380 B1 * 2/2001 Kawashima ..... G02F 1/1336 250/214 AG
2007/0211013 A1 * 9/2007 Uehara ..... G09G 3/3413 345/102
2008/0100645 A1 * 5/2008 Nitta ..... G09G 3/3426 345/690
2008/0112164 A1 * 5/2008 Teshirogi ..... G09G 3/3426 362/231
2008/0123022 A1 * 5/2008 Aoki ..... G02F 1/133603 349/68
2009/0224678 A1 * 9/2009 Wang ..... G09G 3/3426 315/158
2012/0081412 A1 * 4/2012 Kim ..... G06F 3/0421 345/690
2012/0274544 A1 * 11/2012 Nakajima ..... G01K 7/42 345/101

FOREIGN PATENT DOCUMENTS

JP 2001-142409 A 5/2001
JP 2009-139470 A 6/2009

* cited by examiner

*Primary Examiner* — Charles Tseng
(74) *Attorney, Agent, or Firm* — Cowan, Liebowitz & Latman, P.C.

(57) ABSTRACT

Provided is a display apparatus including: a light emitting unit having a light source; a display unit configured to display an image by controlling a transmittance of light from the light emitting unit; first and second sensors provided in the light emitting unit to detect a brightness of the light source; and a control unit configured to control a transmittance of the display unit on the basis of detection values from the first and second sensors. A distance from the light source to the second sensor is longer than a distance from the light source to the first sensor. The control unit controls the transmittance of the display unit on the basis of a change degree of the detection value from the first sensor during a given period and a change degree of the detection value from the second sensor during the period.

15 Claims, 18 Drawing Sheets

101

| | | | | | | |
|---|---|---|---|---|---|---|
| 111 (1,1) | 111 (1,2) | 111 (1,3) | 111 (1,4) | 111 (1,5) | 111 (1,6) | 111 (1,7) |
| 111 (2,1) | 111 (2,2) | 111 (2,3) | 111 (2,4) | 111 (2,5) | 111 (2,6) | 111 (2,7) |
| 111 (3,1) | 111 (3,2) | 111 (3,3) | 111 (3,4) | 111 (3,5) | 111 (3,6) | 111 (3,7) |
| 111 (4,1) | 111 (4,2) | 111 (4,3) | 111 (4,4) | 111 (4,5) | 111 (4,6) | 111 (4,7) |
| 111 (5,1) | 111 (5,2) | 111 (5,3) | 111 (5,4) | 111 (5,5) | 111 (5,6) | 111 (5,7) |

*Fig.3*

| TIME T IN ACCELERATED DETERIORATION TEST | DETECTION VALUE $V_{S1}$ FROM CLOSE OPTICAL SENSOR | DETECTION VALUE $V_{S2}$ FROM DISTANT OPTICAL SENSOR | DECREASE RATE OF DETECTION VALUE FROM CLOSE OPTICAL SENSOR $R_{S1}=1-V_{S1}(T)/V_{S1}(T_0)$ | DECREASE RATE OF DETECTION VALUE FROM DISTANT OPTICAL SENSOR $R_{S2}=1-V_{S2}(T)/V_{S2}(T_0)$ | FRACTIONAL DECREASE RATE DUE TO DEGRADATION OF OPTICAL MEMBER $R_{YEL}=R_{S2}-R_{S1}$ |
|---|---|---|---|---|---|
| $T_0$ (TIME WHEN TEST IS STARTED) | 1000 | 100 | 0.00 | 0.00 | 0.00 |
| $T_1$ | 950 | 90 | 0.05 | 0.10 | 0.05 |
| $T_2$ | 900 | 80 | 0.10 | 0.20 | 0.10 |
| $T_3$ | 850 | 70 | 0.15 | 0.30 | 0.15 |
| $T_4$ | 800 | 60 | 0.20 | 0.40 | 0.20 |
| $T_5$ | 750 | 50 | 0.25 | 0.50 | 0.25 |
| $T_6$ | 700 | 40 | 0.30 | 0.60 | 0.30 |
| ... | ... | ... | ... | ... | ... |

*Fig.12*

DISPLAY APPARATUS AND CONTROL METHOD THEREOF

BACKGROUND OF THE INVENTION

Field of the Invention

The present invention relates to a display apparatus and a control method thereof.

Description of the Related Art

Some examples of color image display apparatuses include a color liquid crystal panel having a color filter, and a light source device (backlight device) which illuminates the back surface of the color liquid crystal panel with white light. Conventionally, as the light source of a light source device, a fluorescent lamp such as Cold Cathode Fluorescent Lamp (CCFL) has been used mainly. However, recent years have seen an increased use of a light emitting diode (LED), which is excellent in terms of power consumption, lifetime, color reproducibility, and environmental load, as the light source of a light source device.

In general, a light source device (LED backlight device) using an LED as a light source has a large number of LEDs. Japanese Patent Application Laid-open No. 2001-142409 discloses an LED backlight device including a plurality of light emitting units each having one or more LEDs. Japanese Patent Application Laid-open No. 2001-142409 also discloses individual control of the brightness of each of the light emitting units. By reducing the emission brightness of the light emitting unit which illuminates with light the region of the screen of a color image display apparatus where a dark image is displayed, power consumption is reduced and the contrast of the image is improved. Such brightness control performed individually for each of the light emitting units in accordance with the characteristic feature of the image is referred to as local dimming control.

On the other hand, when a bright image and a dark image are adjacent to each other in the local dimming control, unevenness referred to as a halo presents a problem. Since the light emitting unit which illuminates with light the region where the bright image is displayed has a high emission brightness, the light from the light emitting unit leaks out into the adjacent region where the dark image is displayed to be visually recognized as unevenness.

To reduce such unevenness, the following method is used. In the method, an emission brightness distribution when each of the light emitting units is individually turned on is obtained in advance. The respective brightnesses of the individual light emitting units that have been determined by local dimming control are subjected to multiplication to be summed up on each other. Thus, the brightness distribution of the light incident on a color liquid crystal panel is determined and, in accordance therewith, the light transmittance of the color liquid crystal panel is adjusted. Japanese Patent Application Laid-open No. 2009-139470 shows an example thereof.

SUMMARY OF THE INVENTION

However, when discoloration, contamination, blur, or the like has occurred in the optical member forming a backlight device due to aging, an emission brightness distribution (hereinafter referred to as individual brightness distribution) and an emission color distribution (hereinafter referred to as individual color distribution) when each of the emitting units is individually turned on change. As a result, the brightness distribution of light incident on the color liquid crystal panel and the color distribution thereof, which are obtained by sum of the individual brightness distributions on each other and sum of the individual color distributions on each other, also change. This causes a problem in that the conventional method cannot sufficiently reduce the unevenness.

To solve the problem, the present invention reduces the unevenness of brightness and chromaticity in a display apparatus including a backlight when discoloration, contamination, blur, or the like has occurred in the optical member forming the backlight due to aging.

A first aspect of the present invention is a display apparatus, comprising:

a light emitting unit having a light source;

a display unit configured to display an image by controlling a transmittance of light from the light emitting unit;

first and second sensors provided in the light emitting unit to detect a brightness of the light source; and a control unit configured to control a transmittance of the display unit on the basis of detection values from the first and second sensors, wherein a distance from the light source to the second sensor is longer than a distance from the light source to the first sensor, and the control unit controls the transmittance of the display unit on the basis of a change degree of the detection value from the first sensor during a given period and a change degree of the detection value from the second sensor during the period.

A second aspect of the present invention is a method of controlling a display apparatus including: a light emitting unit having a light source; a display unit configured to display an image by controlling a transmittance of light from the light emitting unit; and first and second sensors provided in the light emitting unit to detect a brightness of the light source, a distance from the light source to the second sensor being longer than a distance from the light source to the first sensor, the method comprising:

acquiring detection values from the first and second sensors; and controlling a transmittance of the display unit on the basis of the detection values from the first and second sensors, wherein in the controlling, the transmittance of the display unit is controlled on the basis of a change degree of the detection value from the first sensor during a given period and a change degree of the detection value from the second sensor during the period.

According to the present invention, in a display apparatus including a backlight, unevenness in brightness and chromaticity can be reduced when discoloration, contamination, blur, or the like has occurred in the optical member forming the backlight due to aging.

Further features of the present invention will become apparent from the following description of exemplary embodiments with reference to the attached drawings.

BRIEF DESCRIPTION OF THE DRAWINGS

FIG. 3 is a schematic diagram showing the arrangement of light emitting units 111 in the light source board 101;

FIG. 12 shows an example of data on the decrease rate of each of the detection values from the optical sensors obtained by an accelerated deterioration test;

DESCRIPTION OF THE EMBODIMENTS

Embodiment 1

A description will be given below of a light source device according to Embodiment 1 of the present invention. In Embodiment 1, an example of the case where the light source device is a backlight device used in a color image display apparatus will be described. However, the light source device is not limited to the backlight device used in a display apparatus. For example, the light source device may also be an illuminating device such as a street lamp or a room lamp.

Figure 1:
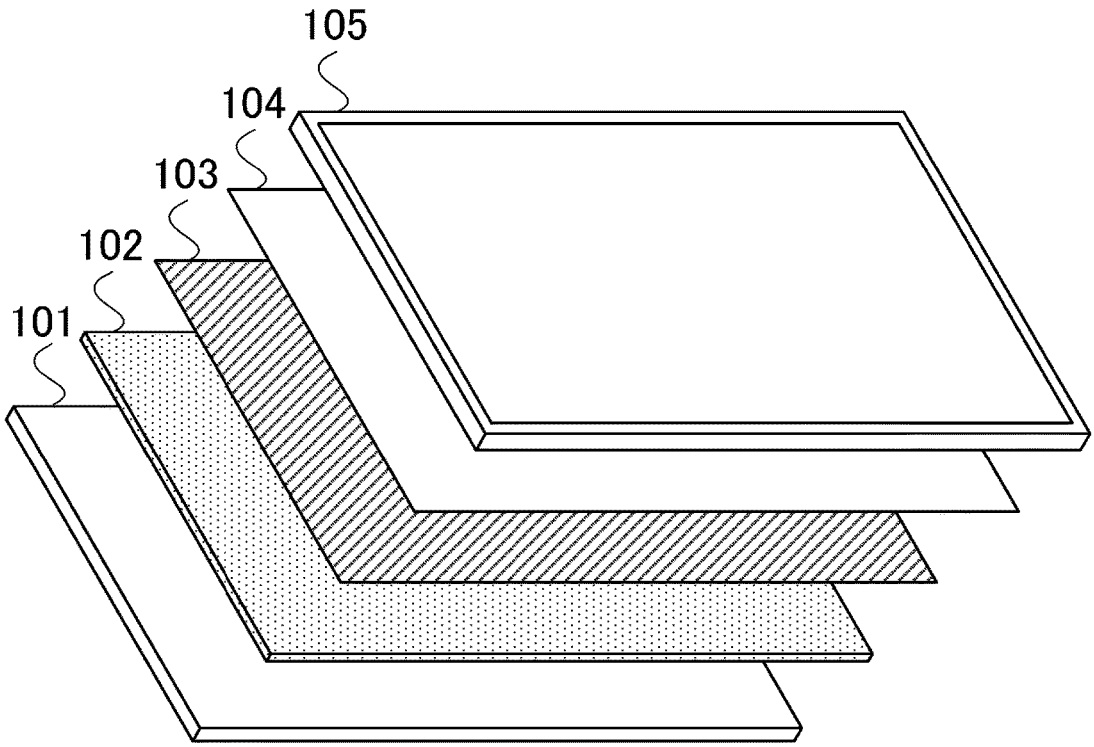
FIG. 1 is a schematic diagram showing an example of a configuration of a color image display apparatus.

FIG. 1 is a schematic diagram showing an example of a configuration of the color image display apparatus according to Embodiment 1. The color image display apparatus has a backlight device, and a color liquid crystal panel 105. The backlight device has a light source board 101, a diffusion plate 102, a light focusing sheet 103, a reflection-type polarization film 104, and the like.

The light source board 101 emits light (white light) which illuminates the back surface of the color liquid crystal panel 105. The light source board 101 is provided with a plurality of light sources. As the light sources, cold cathode-ray tubes, organic EL elements, or the like can also be used besides the light emitting diodes (LEDs).

The diffusion plate 102, the light focusing sheet 103, and the reflection-type polarization film 104 which are shown in FIG. 1 are placed in parallel with the light source board to cause an optical change in the light from the light source board 101.

Specifically, the diffusion plate 102 reflects/diffuses the light from the foregoing plurality of light sources (LED chips in Embodiment 1) to cause the light source board 101 to function as a surface light source.

The light focusing sheet 103 focuses the light, which has been reflected/diffused by the diffusion plate 102 and incident at various angles of incidence, in a front direction (toward the color liquid crystal panel 105) to improve front brightness (brightness in the front direction).

The reflection-type polarization film 104 efficiently reflects/polarizes the incident white light to improve the front brightness.

To the top surface of the light source board 101, a reflection sheet (not shown) with a high reflectance has been stuck to return reflected light from the diffusion plate 102, the light focusing sheet 103, and the reflection-type polarization film 104 toward the light source board 101 back to the color liquid crystal panel 105.

Note that the display apparatus may also include a member other than the optical members described above and need not include at least any one of the optical members described above.

The color liquid crystal panel 105 has a plurality of pixels each including an R factice-pixel which transmits red light, a G factice-pixel which transmits green light, and a B factice-pixel which transmits blue light. The color liquid crystal panel 105 controls the transmittance of the emitted white light on a per-factice-pixel basis to display a color image. Note that, in the display apparatus of the present invention, display unit for displaying an image by controlling the transmittance of the light from the backlight is not limited to the liquid crystal panel. For example, the display unit may also be an MEMS-shutter display using a micro electromechanical system (MEMS) shutter instead of a liquid crystal element.

A backlight device having a configuration as described above (configuration as shown in FIG. 1) is generally referred to as a direct-lit backlight device.

Figure 2:
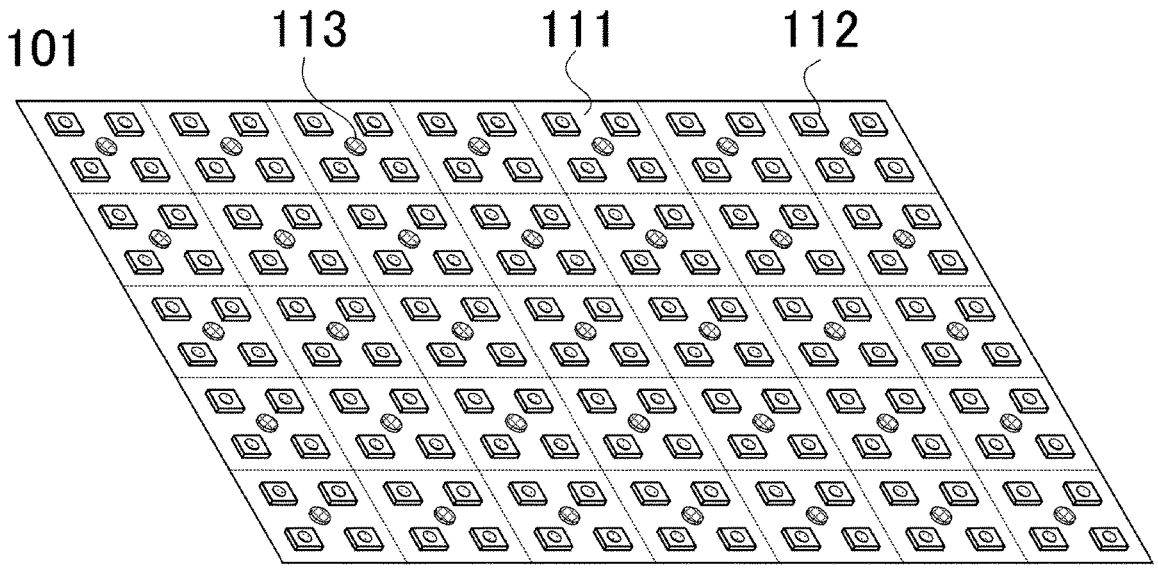
FIG. 2 is a schematic diagram showing an example of a configuration of a light source board 101.

FIG. 2 is a schematic diagram showing an example of a configuration of the light source board 101.

The light source board 101 has five light emitting units 111 in a vertical direction and seven light emitting units 111 in a lateral direction. That is, the light source board 101 has the total of thirty-five light emitting units 111 in five rows and seven columns.

The respective emission brightnesses (amounts of emission) of the light emitting units 111 can individually be controlled. Each of the light emitting units 111 is provided with four light sources (LED chips 112). As each of the LED chips 112, a white LED which emits white light can be used. As each of the LED chips 112, a chip configured to be able to provide white light using a plurality of LEDs which emit light beams in different colors (such as, e.g., a red LED which emits red light, a green LED which emits green light, and a blue LED which emits blue light) may also be used.

The light source board 101 is provided with optical sensors 113 which detect light and output detection values. The light from each of the light emitting units 111 is partly reflected by the diffusion plate, the reflection-type polarization film, and the like and returned toward the light emitting unit. Each of the optical sensors 113 detects the light reflected by the diffusion plate, the reflection-type polarization film, and the like and returned toward the light emitting unit in addition to the light directly incident thereon from the light emitting unit 111. In Embodiment 1, a microcomputer 125 described later detects a brightness change due to the degradation and temperature characteristics of the LEDs in each of the light emitting unit 111 from detection value from the optical sensor 113. The microcomputer 125 further detects the change of each of an individual brightness distribution and an individual color distribution due to the occurrence of discoloration, contamination, blur, or the like in the optical member forming the backlight device due to aging using the detection value from the optical sensor 113 (the details thereof will be described later). The individual brightness distribution is a brightness distribution in the color liquid crystal panel 105 due to light from each of the light emitting units. The individual color distribution is a color distribution in the color liquid crystal panel 105 due to the light from each of the light emitting units.

In Embodiment 1, each of the light emitting units 111 is provided with the optical sensor 113 on a one-by-one basis. As the optical sensor 113, a sensor which outputs a brightness as a detection value, such as a photodiode or phototransistor, can be used. A color sensor which outputs a brightness on a per-color basis may also be used as the optical sensor 113. Note that the number and locations of the optical sensors 113 are not limited to those in the example described in Embodiment 1. As will be described later, it is sufficient as long as at least two optical sensors are provided in the backlight device. The at least two optical sensors are a first sensor at a shorter distance from the light emitting unit 111 and a second sensor at a longer distance therefrom which are caused to emit light when a sensor value is acquired.

FIG. 3 is a schematic diagram showing an example of the arrangement of the light emitting units 111 in the light source board 101 when the light source board 101 is viewed from the front direction (from the color liquid crystal panel 105).

Among the light emitting units 111(X,Y) (Vertical Direction X=1 to 5, Lateral direction Y=1 to 7), the light emitting unit 111(1,1) is placed at the upper left end. On the right side of the light emitting unit 111(1,1), the light emitting units 111(1,2), 111(1,3), 111(1,4), 111(1,5), 111(1,6), and 111(1,7) are successively arranged. Under the light emitting unit 111(1,1), the light emitting units 111(2,1), 111(3,1), 111(4,1), and 111(5,1) are successively arranged.

Figure 4:
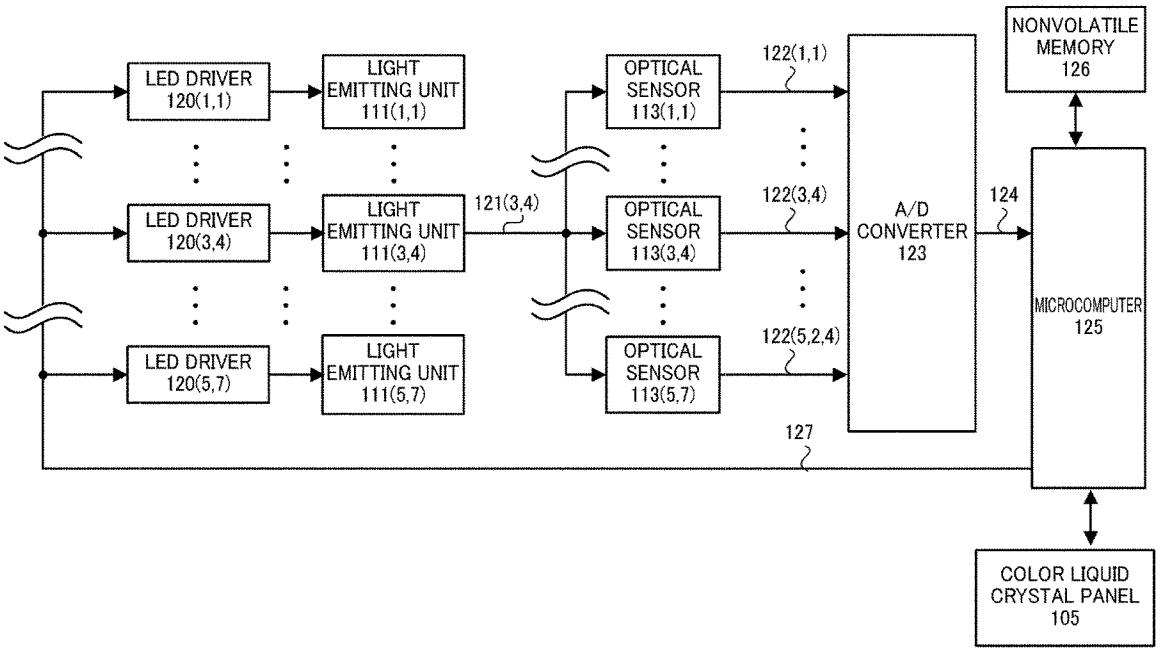
FIG. 4 is a block diagram showing control of an amount of emission from each of the light emitting units 111 on the basis of optical sensor values.

FIG. 4 is a block diagram showing the relations among individual portions in the process performed by the microcomputer 125 in Embodiment 1, i.e., the process in which the microcomputer 125 causes the light emitting units 111 to emit light, acquires detection values from the optical sensors 113, and performs unevenness correction.

The microcomputer 125 may also perform the process of sensor value detection and correction during a vacant time during which a user does not use the color image display apparatus or during a short time during which the user uses the color image display apparatus but the process performed by the microcomputer 125 is visually unrecognized by the user. The microcomputer 125 periodically performs the process of sensor value detection and correction at given intervals.

The microcomputer 125 causes the light emitting unit 111(3,4) as a detection target to emit light, while forcibly turning off the other light emitting units 111. The major part of light 121(3,4) emitted from the light emitting unit 111(3,4) is incident on the color liquid crystal panel 105 (not shown in FIG. 4). However, the light 121(3,4) is partly returned as reflected light from the diffusion plate, the reflection-type polarization film (not shown), and the like toward the light emitting unit. A close optical sensor 113(3,4) provided in the light emitting unit 111(3,4) additionally detects the reflected light as well as the light directly incident thereon from the light emitting unit 111(3,4). The major part of the reflected light is reflected again by the reflection sheet (not shown) stuck onto the light source board 101 (not shown) toward the color liquid crystal panel 105 (not shown). The light 121(3,4) repeatedly reflected by each of the optical members several times is incident also on the optical sensor 113 distant from the light emitting unit 111(3,4). Each of the optical sensors 113 outputs an analog value 122 (detection value) representing the brightness of detected light in accordance with the brightness.

The subsequent processes include the process of detecting a brightness change due to the degradation and temperature characteristics of the LEDs in each of the light emitting units 111 and the process of detecting the change of each of the individual brightness distribution and the individual color distribution due to the occurrence of discoloration, contamination, blur, or the like in the optical member due to aging. First, a description will be given of the former process.

An A/D converter 123 selects, among the analog values 122 output from the individual sensors 113, an analog value 122(3,4) output from the close optical sensor 113(3,4) provided in the light emitting unit 111(3,4). Then, the A/D converter 123 converts the selected analog value to a digital value through analog-digital conversion and outputs a digital value 124 to the microcomputer 125. The microcomputer 125 adjusts the emission brightness of the light emitting unit 111(3,4) on the basis of the detection value (specifically, a digital value 124(3,4)) from the optical sensor 113(3,4).

The description has been given heretofore of the case where the light emitting unit 111(3,4) is turned on as a representative and detection is performed. However, the same process is performed for each of the other light emitting units 111. That is, in the state where only the light emitting unit 111 for which the process is to be performed is caused to emit light, the brightness thereof is detected by the close optical sensor 113 provided in each of the light emitting units. In the A/D converter 123, the analog value 122 of the optical sensor 113 provided in the light emitting unit 111 the emission brightness of which is to be adjusted is converted to the digital value 124, and the digital value 124 is output to the microcomputer 125. As a result, from the A/D converter 123, the total of thirty-five detection values (detection values from the optical sensors, i.e., the digital values 124) is output to the microcomputer 125.

The microcomputer 125 adjusts the emission brightness of each of the light emitting units 111 on the basis of the detection value (specifically, the digital value 124) from each of the optical sensors 113. Specifically, the microcomputer 125 has stored, in a nonvolatile memory 126, a reference brightness value (reference value for the detection value) for each of the light emitting units 111, which was determined during the manufacturing/inspection of the color image display apparatus. The microcomputer 125 compares, for each of the light emitting units 111, the detection value from the optical sensor 113 provided in the light emitting unit 111 to the foregoing reference value. Then, the microcomputer 125 individually adjusts the emission brightness of each of the light emitting units 111 in accordance with the result of the foregoing comparison so as to bring the detection value closer to the reference value. The microcomputer 125 adjusts the emission brightness by, e.g., adjusting an LED driver control signal 127 to be output from the microcomputer 125 to an LED driver 120. The LED driver 120 drives the light emitting unit 111 in accordance with the LED driver control signal 127. The LED driver control signal 127 represents, e.g., the pulse width of the pulse signal (current or voltage pulse signal) applied to the light emitting unit 111. In that case, the microcomputer 125 adjusts the LED driver control signal 127 to subject the emission brightness of the light emitting unit 111 to PWM control. Note that the LED driver control signal 127 is not limited thereto. For example, the LED driver control signal 127 may represent the wave height value of the pulse signal applied to the light emitting unit 111 or may represent each of the pulse width and the wave height value thereof. By adjusting the emission brightness of each of the light emitting units 111 so as to bring the detection value closer to the reference value, even when a brightness change has occurred due to the degradation and temperature characteristic of the light emitting unit 111, the brightness unevenness of the entire backlight device can be suppressed.

Next, a description will be given of the process of detecting the change of each of the individual brightness distribution and the individual color distribution due to the occurrence of discoloration, contamination, blur, or the like in the optical member forming the backlight device due to aging and adjusting the transmittance of the color liquid crystal panel so as to compensate for the change. However, only the outline of the process is described herein using FIG. 4, and the details thereof will be described later.

It is assumed that the detection of the change of each of the individual brightness distribution and the individual color distribution is performed using a representative one of the light emitting units 111. A description is given herein of an example using the light emitting unit 111(3,4) located at the center of the backlight device. This is conceivably because, in the same backlight device, the state of discoloration, contamination, blur, or the like in the optical member due to aging could not differ from region to region. However, in a structure in which the temperature considerably differs from region to region and aging tends to differ from region to region, the same detection and correction may also be performed individually for each of the regions.

The A/D converter 123 first selects, among the analog values 122 output from the individual optical sensors 113, the analog value 122(3,4) output from the close optical sensor 113(3,4) (first sensor) provided in the light emitting unit 111(3,4). Then, the A/D converter 123 converts the selected analog value to a digital value through analog-digital conversion and outputs the digital value 124 to the microcomputer 125. Then, the A/D converter 123 selects the analog value 122(3,7) output from the optical sensor distant from the light emitting unit 111(3,4), which is the optical sensor 113(3,7) (second sensor) herein. Then, the A/D converter 123 similarly converts the selected analog value to a digital value through analog-digital conversion and outputs the digital value 124 to the microcomputer 125. During the manufacturing/inspection of the color image display apparatus also, the microcomputer 125 acquired the detection values from the close and distant optical sensors 113(3,4) and 113(3,7) that detected the light 121(3,4) from the light emitting unit 111(3,4) by the same procedure. These detection values have been stored as reference values in the nonvolatile memory 126.

From the respective detection values from the close and distant optical sensor 113(3,4) and 113(3,7) thus acquired and the respective reference values therefor, the microcomputer 125 determines a fractional decrease rate $R_{YEL}$ due to the degradation of the optical member in a decrease rate R of the detection value from the distant optical sensor 113(3, 7). The decrease rate may be decrease degree. An accelerated deterioration test is performed in advance using an equivalent color image display apparatus as a sample to evaluate the correspondence relationship between the fractional decrease rate $R_{YEL}$ due to the degradation of an optical member that has been determined by a similar detection method and each of the individual brightness distribution and the individual color distribution. In the color image display apparatus used by a user, information on the foregoing correspondence relationship is stored in advance in the nonvolatile memory 126 during manufacturing. When the user starts to use the color image display apparatus, the microcomputer 125 determines the fractional decrease rate $R_{YEL}$ due to the degradation of the optical member by regular detection. The microcomputer 125 obtains the individual brightness distribution and the individual color distribution which correspond to the fractional decrease rate $R_{YEL}$ due to the degradation of the optical member from the magnitude of the fractional decrease rate $R_{YEL}$ and the information on the foregoing correspondence relationship stored in the nonvolatile memory 126. The details of this process will be described later.

First, a description will be given of a method of determining the fractional decrease rate $R_{YEL}$ due to the degradation of the optical member in the decrease rate R of the detection value from the distant optical sensor.

Figure 5:
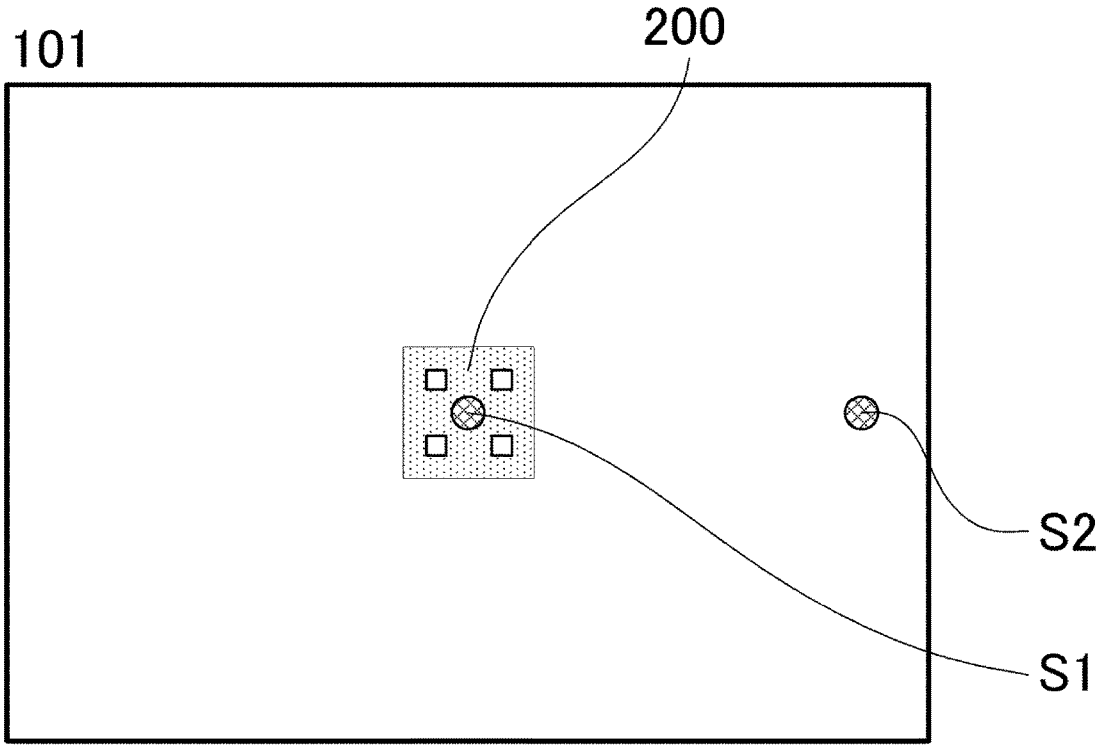
FIG. 5 is a schematic diagram showing the locations of a light emitting unit 200, a close optical sensor S1, and a distant optical sensor S2.

FIG. 5 is a schematic diagram showing the locations of a light emitting unit 200 used to detect the change of each of the individual brightness distribution and the individual color distribution, a close optical sensor S1, and a distant optical sensor S2 when viewed from the front direction (from the color liquid crystal panel 105).

As the light emitting unit 200 used to detect the change of each of the individual brightness distribution and the individual color distribution, the light emitting unit 111(3,4) located at the center of the light source board 101 is used. As the close optical sensor S1 (first sensor), the optical sensor 113(3,4) provided in the light emitting unit 111(3,4) is used. As the distant optical sensor (second sensor), the optical sensor 113(3,7) is used herein.

On the close optical sensor S1, not only light is directly incident from the light emitting unit 111(3,4), but also the light reflected by the diffusion plate and the reflection-type polarization film is incident. However, the number of times the light is reflected is small. Consequently, a detection value from the close optical sensor S1 is barely affected by discoloration, contamination, blur, or the like in the optical member due to aging.

On the other hand, on the distant optical sensor S2, the light from the light emitting unit 111(3,4) is seldom directly incident, but the light that has been reflected a considerable number of times is incident. Consequently, the influence of discoloration, contamination, blur, or the like in the optical member due to aging increases, which will be described using FIGS. 6 and 7.

Figure 6:
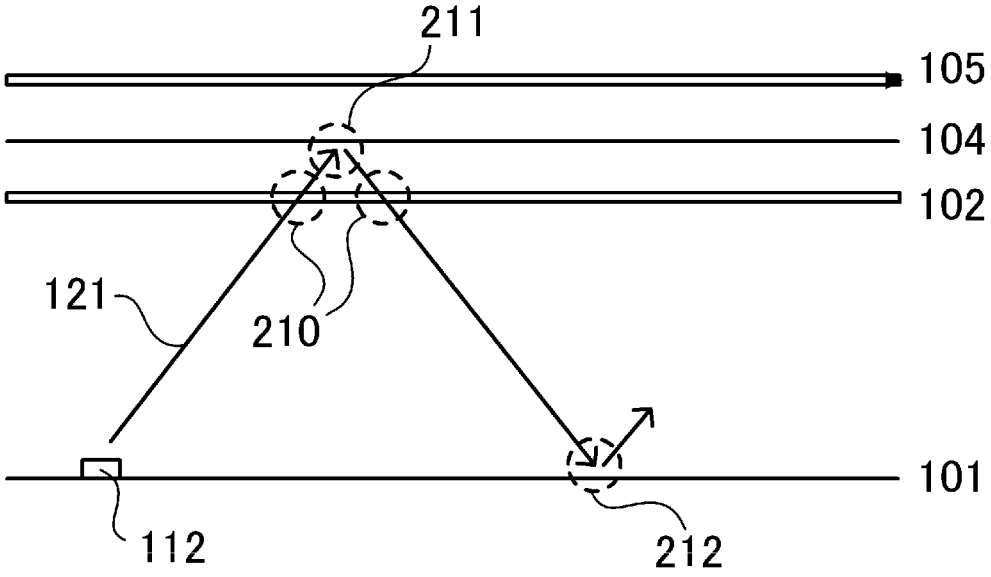
FIG. 6 is a schematic diagram of reflection of light in a backlight device when viewed in a cross section.

FIG. 6 is a schematic diagram of reflection of light in the backlight device when viewed in a cross section.

From the LED chip 112, light 121 is emitted in the direction of the color liquid crystal panel 105. The light 121 gradually travels in the backlight device, while subjected to repeated transmission and reflection including transmission (210) by the diffusion plate 102 (210), reflection (211) by the reflection-type polarization film 104, and reflection (212) by the reflection sheet over the light source board 101.

Figure 7:
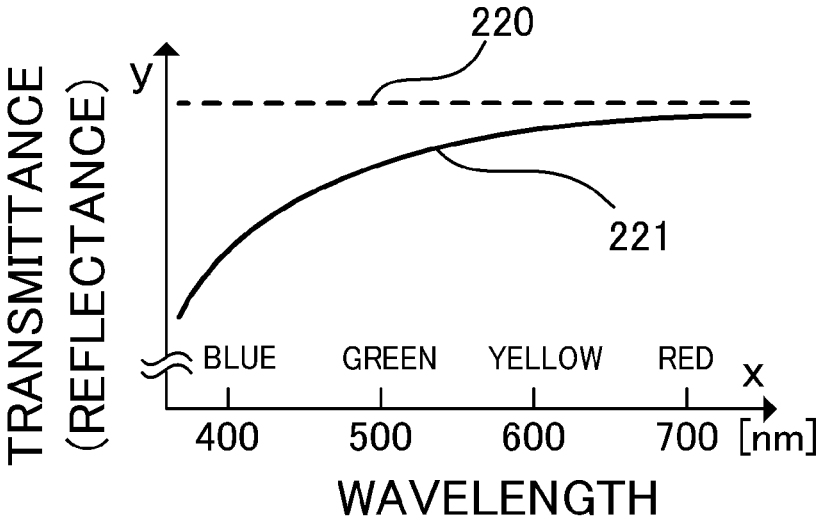
FIG. 7 is a graph showing an example of the change of a spectral transmittance (reflectance) due to the aging degradation of an optical member.

FIG. 7 is a graph showing an example of the change of a spectral transmittance (reflectance) when discoloration, contamination, and blur has occurred in the optical member due to aging.

In general, an optical member is formed of a resin. For example, polycarbonate is used for the diffusion plate 102, while polyethylene naphthalate is used for the reflection-type polarization film 104 and the reflection sheet. A resin material is likely to be modified by heat or light. Since heat and light is emitted from the LEDs of the backlight device, modification cannot be avoided. When a power supply time exceeds ten thousand hours, the influence of such discoloration, contamination, and blur becomes prominent, though the degree thereof differs depending on temperature and humidity conditions in an installation environment.

It is assumed that a spectral transmittance (reflectance) 220 in an initial state (immediately after manufacturing) has a flat characteristic at each wavelength in a visible light band (400 to 700 nm). By contrast, a spectral transmittance (reflectance) 221 after a lapse of time decreases particularly in the blue color (short wavelength) range so that transmitted (reflected) light is discolored into yellow. The transmittance (reflectance) considerably decreases at all the wavelengths including the red color (long wavelength) range so that the optical member is recognized to be rather blurred. In addition, gas may be emitted from another member due to aging and deposited to result in contamination.

Every time the transmission or reflection of the light 121 emitted from each of the LED chips 112 by the optical member is repeated, the light 121 undergoes a reduction in spectral transmittance (reflectance), as shown in FIG. 7. That is, the light that has reached a place distant from the LED chip 112 of the light emitting unit 111 and is detected by the distant optical sensor S2 is significantly affected by discoloration, contamination, and blur due to aging.

In Embodiment 1, it is assumed that the optical sensor 113(3,7) used as the distant optical sensor S2 is sufficiently distant from the light emitting unit 111 (3,4) and the distance therebetween is about six times the diffusion distance (distance between each of the LED chips 112 mounted on the light source board 101 and the diffusion plate 102) of the backlight device in the present embodiment. It follows that, when the diffusion distance is 30 mm, the optical sensor 113(3,7) is 180 mm distant from the light emitting unit 111(3,4). In general, when the distance therebetween is not less than several times the diffusion distance, the light reflected by the optical member a considerable number of times is incident. Accordingly, it is possible to detect the influence of discoloration, contamination, and blur due to aging.

Figure 8:
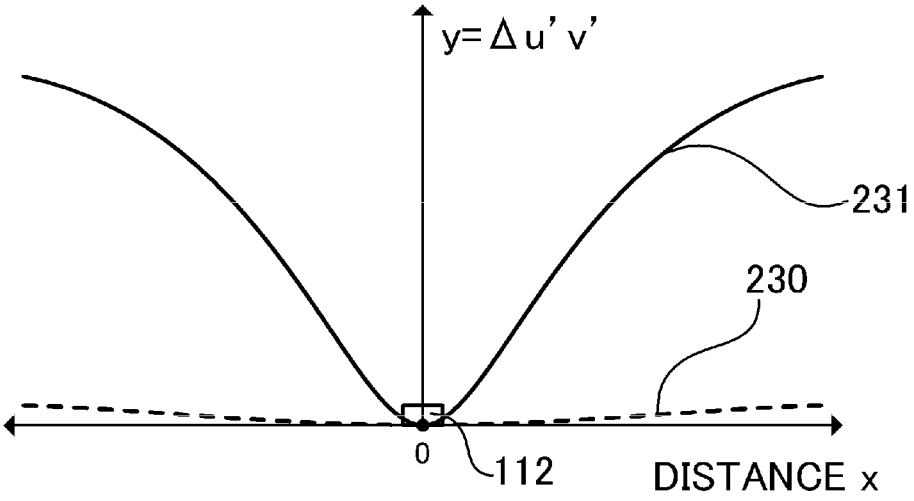
FIG. 8 is a graph showing the change of an individual color distribution due to lapse of time.

FIG. 8 is a graph showing the change of the individual color distribution due to lapse of time.

The x-axis represents the distance from each of the LED chips 112, and the LED chip 112 is placed at DISTANCE x=0. The y-axis shows a color difference Δu'v' based on the chromaticity of light immediately over the LED chip 112 (over the diffusion plate 102) used as a reference (y=0). The color difference was measured from outside the backlight device using a surface brightness meter.

In a curve 230 obtained in an initial state (immediately after manufacturing), even though light has been emitted away from the LED chip 112 and reflected by the optical member a considerable number of times, the color difference scarcely increases.

In a curve 231 obtained after a lapse of time, as light has been emitted farther away from the LED chip 112 and reflected by the optical member a larger number of times, the color difference increases.

A detection value from the close optical sensor S1 corresponds to a value around DISTANCE x=0 in the distribution shown in FIG. 8. Since the number of times light has been reflected by the optical member is zero or small, the detection value is immune to the influence of discoloration, contamination, blur, or the like in the optical member due to aging.

A detection value from the distant sensor S2 corresponds to a value at a sufficiently increased distance x in the distribution shown in FIG. 8. Since the light has been reflected by the optical member a considerable number of times, the detection value is significantly affected by aging. More specifically, the light in which a component in the blue color (short wavelength) range has decreased due to the reflection by the optical member is detected so that the detection value decreases.

Figure 9:
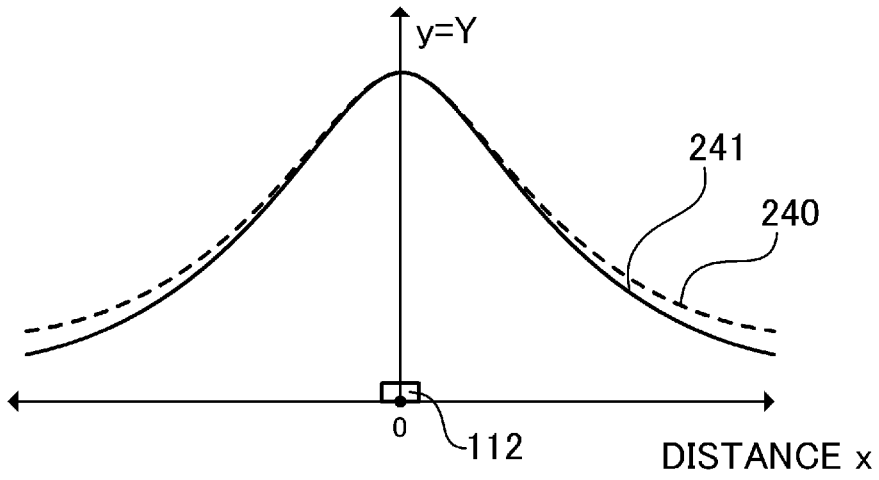
FIG. 9 is a graph showing the change of an individual brightness distribution due to lapse of time.

FIG. 9 is a graph showing the change of the individual brightness distribution due to lapse of time.

The x-axis represents the distance from each of the LED chips 112. The LED chip 112 is placed at DISTANCE x=0. The y-axis represents a brightness Y which has the apex immediately over the LED chip 112 (over the diffusion plate 102). The brightness Y was measured from outside the backlight device using a surface brightness meter. Each of the curves has been normalized with the brightness (apex) at DISTANCE x=0.

In a curve 240 obtained in the initial state (immediately after manufacturing), the brightness decreases with distance from the LED chip 112. This is a typical characteristic feature of an individual brightness distribution in a direct-lit backlight device.

In a curve 231 obtained after a lapse of time, an amount of brightness decrease with distance from the LED chip 112 is larger than in the curve 240 obtained in the initial state (immediately after manufacturing).

The detection value from the close optical sensor S1 corresponds to a value around DISTANCE x=0 in the distribution shown in FIG. 9. Since the number of times light has been reflected by the optical member is zero or small, the detection value is immune to the influence of discoloration, contamination, blur, or the like in the optical member due to aging. Accordingly, the close optical sensor S1 mainly detects a brightness decrease due to the aging degradation of the LED chip 112.

The detection value from the distant optical sensor S2 corresponds to a value at a sufficiently increased distance x in the distribution shown in FIG. 9. Since the light has been reflected by the optical member a considerable number of times, the detection value is affected by aging. More specifically, the distant optical sensor S2 detects the light in which the brightness has been reduced by the reflection by the optical member so that the detection value therefrom decreases.

Figure 10:
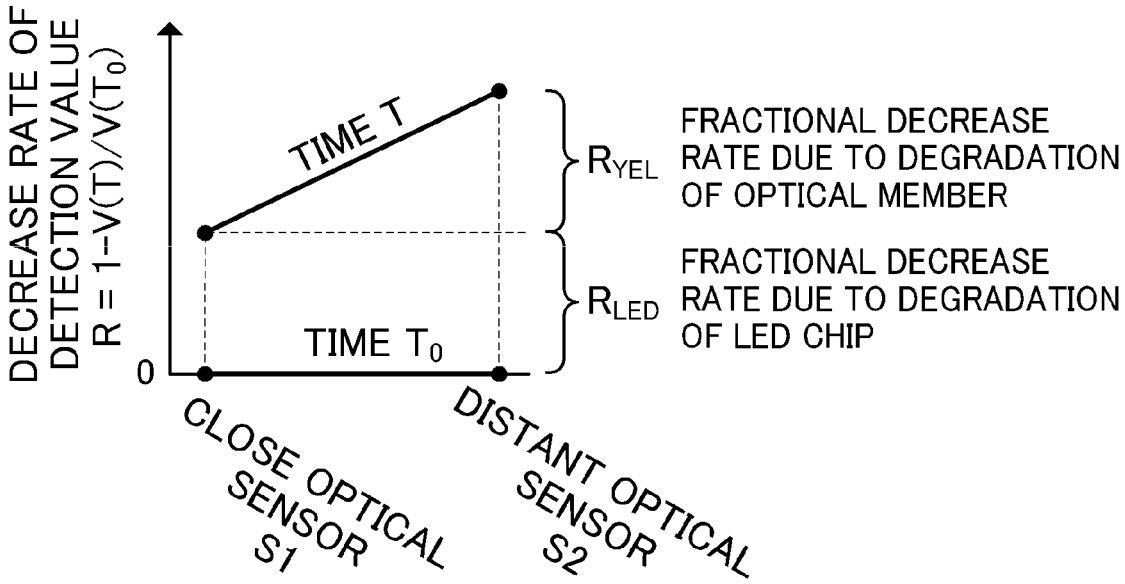
FIG. 10 is a graph showing a decrease rate R in each of detection values from the optical sensors.

FIG. 10 is a graph showing the details of the decrease rate R in each of the detection values from the close and distant optical sensors S1 and S2.

First, the decrease rate R in each of the detection values is defined as in Expression 1:

[Math 1]

$$R=1-V(T)/V(T_0) \qquad \text{Expression 1}$$

In Expression 1, V(T) represents the detection value from each of the optical sensors 113 at a time T and $V(T_0)$ represents the detection value in the initial state (during the manufacturing/inspection of the color image display apparatus). Expression 1 shows how much the detection value V(T) has decreased relative to the detection value $V(T_0)$. In the initial state, the decrease rate R is 0, which shows that the detect value has not decreased. The decrease rate R at the given time T has a value larger than 0 and smaller than 1, which shows that the detection value has decreased with approach to 1.

In FIG. 10, in the initial state ($T=T_0$), the decrease rate R is 0 in either of the close and distant optical sensors S1 and S2.

At the time T when a sufficient power supply time has elapsed, the decrease rate R of the detection value is larger than 0. The number of times the light detected by the close optical sensor S1 has been reflected by the optical member is zero or small. Consequently, the detection value is immune to the influence of discoloration, contamination, blur, or the like in the optical member due to aging. Accordingly, the decrease rate R includes only the fractional decrease rate $R_{LED}$ due to the degradation of the LED chip. On the other hand, the light detected by the distant optical sensor S2 has been reflected by the optical member a considerable number of times and affected by discoloration, contamination, blur, or the like in the optical member due to aging. Consequently, the decrease rate R includes the fractional decrease rate $R_{YEL}$ due to the degradation of the optical member. In addition, the decrease rate R also includes the fractional decrease rate $R_{LED}$ due to the degradation of the LED chip equal to the factional decrease rate $R_{LED}$ in the close optical sensor S1.

Accordingly, by subtracting the decrease rate $R=R_{LED}$ in the close optical sensor S1 from the decrease rate R of the detection value from the distant optical sensor S2, the fractional decrease rate $R_{YEL}$ due to the degradation of the optical member in the decrease rate R of the detection value from the distant optical sensor S2 can be determined.

Next, a description will be given of the process of preliminarily performing an accelerated deterioration test using an equivalent color image display apparatus as a sample and evaluating the correspondence relationship between the fractional decrease rate $R_{YEL}$ due to the degradation of the optical member and each of the individual brightness distribution and the individual color distribution.

The degradation of the optical member is conspicuous when ten thousand hours is exceeded, but it is difficult to preliminarily evaluate the degradation of the optical member in actual time. Accordingly, a test is performed herein under several tens of times accelerated conditions and the degradation of the optical member up to the assumed maximum lifetime of the color image display apparatus is fully evaluated. For example, when the maximum lifetime is assumed to be hundred thousand hours, the test is completed in about 100 days under the accelerated conditions.

First, by assuming that the test is started (initial state) at a time $T_0$, the decrease rate R of the detection value from the close optical sensor S1 and the decrease rate R of the detection value from the distant optical sensor S2 are periodically acquired. For example, acquiring the decrease rates R every 24 hours corresponds to acquiring the decrease rates R every 1000 hours in actual time.

Figure 11:
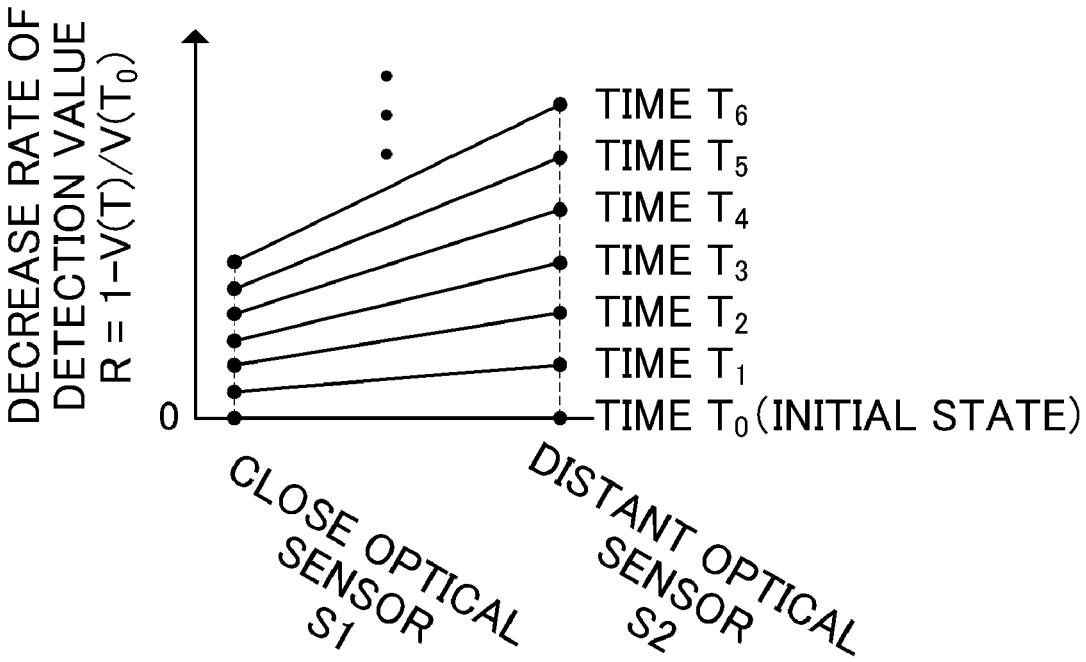
FIG. 11 is a graph showing the relationship between the decrease rate R of each of the detection values from the optical sensors and a time T.

FIG. 11 is a graph showing the relationship between the decrease rate R in each of the close and distant optical sensors S1 and S2 and the time T.

The decrease rate R in the close optical sensor S1 includes only the fractional decrease rate $R_{LED}$ due to the degradation of the LED chip. The fractional decrease rate $R_{LED}$ gradually increases with lapse of the time T. The decrease rate R in the distant optical sensor S2 includes the fractional decrease rate $R_{YEL}$ due to the degradation of the optical member in addition to the fractional decrease rate $R_{LED}$ due to the degradation of the LED chip. As a result, at any time T, the decrease rate R in the distant optical sensor S2 is higher.

FIG. 12 shows an example of data showing the relationship between the detection vales at each of the times T and the fractional decrease rate $R_{YEL}$ due to the degradation of the optical member that has been determined from the detection values in the accelerated deterioration test.

At the time $T_0$ when the test is started (in the initial state), a detection value $V_{S1}$ from the close optical sensor S1 is 1000. At this time, a detection value $V_{S2}$ from the distant optical sensor S2 is 100. The amount of light incident on the distant optical sensor S2 is smaller than the amount of light incident on the close optical sensor S1 so that the detection value is also small. Using these detection values as a reference, the decrease rate R is determined at each of the subsequent times T. For example, at a time $T_3$, the detection value $V_{S1}$ is 850 and the detection value $V_{S2}$ is 70, while a decrease rate $R_{S1}$ of the detection value in the close optical sensor S1 is determined to be 0.15 and a decrease rate $R_{S2}$ of the detection value in the distant optical sensor S2 is determined to be 0.30. The fractional decrease rate $R_{YEL}$ due to the degradation of the optical member in the decrease rate $R_{S2}$ is determined to be 0.15 by subtracting the decrease rate $R_{S1}$ from the decrease rate $R_{S2}$.

Thus, the fractional decrease rate $R_{YEL}$ due to the degradation of the optical member at each of the times T is determined. At the same time, at each of the times T, an individual color distribution and an individual brightness distribution as shown in FIGS. 8 and 9 are measured from outside the backlight device using a surface brightness meter. In this manner, the correspondence relationship between the fractional decrease rate $R_{YEL}$ and each of the individual brightness distribution and the individual color distribution is determined.

In the evaluation based on the accelerated deterioration test, an average result may also be obtained from sample data from several backlight devices.

Next, a description will be given of the process of periodically detecting, in the color image display apparatus used by the user, the change of each of the individual brightness distribution and the individual color distribution due to lapse of time using the result of the evaluation based on the accelerated deterioration test and performing correction.

In the accelerated deterioration test, the correspondence relationship between the fractional decrease rate $R_{YEL}$ due to the degradation of the optical member and each of the individual brightness distribution and the individual color distribution is determined. In the color image display apparatus used by the user, information on the correspondence relationship is stored in advance in the nonvolatile memory 126 during manufacturing.

When the user starts to use the color image display apparatus, the microcomputer 125 periodically detects sensor values from the optical sensors S1 and S2 to determine the fractional decrease rate $R_{YEL}$ due to the degradation of the optical member in the detection value from the distant optical sensor S2. When the factional decrease rate $R_{YEL}$ due to the degradation of the optical member increases with time, the microcomputer 125 detects the change of each of the individual brightness distribution and the individual color distribution.

The microcomputer 125 performs the process of obtaining the brightness distribution and color distribution of light incident on the color liquid crystal panel by sum of the individual brightness distributions on each other and sum of the individual color distributions on each other in each of the light emitting units 111 and adjusting the light transmittance of the color liquid crystal panel 105 in accordance with the brightness distribution and the color distribution to reduce unevenness. On detecting the change of each of the individual brightness distribution and the individual color distribution from a change in the fractional decrease rate $R_{YEL}$, the microcomputer 125 newly reads the individual brightness distribution and the individual color distribution which correspond to the current fractional decrease rate $R_{YEL}$ from the nonvolatile memory. Then, the microcomputer 125 corrects the image signal to be input to the color liquid crystal panel 105 to perform an unevenness reducing process. A description will be given of the process using FIGS. 13 and 14.

Figure 13A:
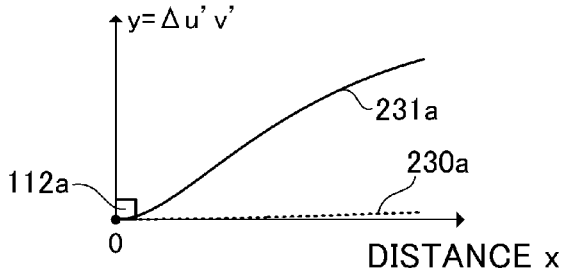
FIGS. 13A to 13C are graphs of individual color distributions in LED chips and a graph obtained by sum of the individual color distributions on each other.

FIG. 13A is a graph showing the change of the individual color distribution due to lapse of time in an LED chip 112*a*. FIG. 13A is equivalent to FIG. 8 and shows a curve 230*a* obtained in the initial state (immediately after manufacturing) and a curve 231*a* obtained after a lapse of time.

Figure 13B:
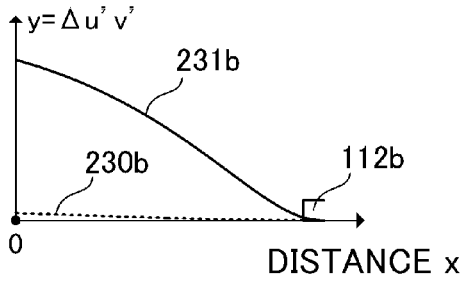

FIG. 13B is a graph showing the change of the individual color distribution due to lapse of time in an LED chip 112*b*. FIG. 13B is also equivalent to FIG. 8, but the position of the LED chip 112*b* is away at a given distance from x=0 serving as a reference point. 230*b* shows a curve obtained in the initial state (immediately after manufacturing) and 231*b* shows a curve after a lapse of time.

The microcomputer 125 calculates to obtain a curve resulting from the superimposition of the individual brightness distributions and a curve resulting from the superimposition of the individual color distributions in each of the light emitting units 111 and obtain the color distribution of the light incident on the color liquid crystal panel 105. Here, for the sake of simplicity, the case is shown where the color distribution of the light incident on the color liquid crystal panel 105 is obtained by sum of the individual color distribution in the LED chip 112*a* in FIG. 13A and the individual color distribution in the LED chip 112*b* in FIG. 13B on each other.

Figure 13C:
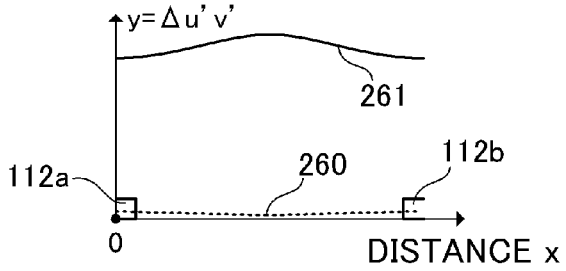

FIG. 13C is a graph showing the color distribution of the light incident on the color liquid crystal panel, which has been obtained by sum of the individual color distributions in the LED chips 112*a* and 112*b* on each other.

A curve 260 shows the color distribution of the light incident on the color liquid crystal panel in an initial state (immediately after manufacturing), which has been obtained by sum of the curves 230*a* and 230*b* in FIG. 13A and FIG. 13B on each other. In the initial state, even in the light emitted away from the LED chip 112 and reflected by the optical member a considerable number of times, the color difference scarcely increases. Accordingly, the curve 260 resulting from the superimposition thereof also scarcely increases irrespective of the distance x.

A curve 261 shows the color distribution of the light incident on the color liquid crystal panel after a lapse of time, which has been obtained by sum of the curves 231*a* and 231*b* in FIGS. 13A and 13B on each other. In the individual color distribution after a lapse of time, as the light has been emitted further away from the LED chip 112 and reflected by the optical member a larger number of times, the color difference increases. However, the curve 261 obtained by sum of the curves 231*a* and 231*b* on each other has the large color difference at each position irrespective of the distance X. In addition, in the curve 261, the color difference varies toward the middle point between the LED chips 112*a* and 112*b*. In the curve 261, the color difference is largest at the middle point between the LED chips 112*a* and 112*b*.

The microcomputer 125 performs the process of adjusting the light transmittance of the color liquid crystal panel 105 in accordance with the color distribution of the light incident on the color liquid crystal panel 105 to reduce unevenness. The microcomputer 125 adjusts the transmittance of the color liquid crystal panel 105 on the basis of the color difference curve shown in FIG. 13C so as to reduce (to zero) the color difference against the power source position (x=0) at each of the distances x in the color distribution of the light after transmitted by the color liquid crystal panel.

The curve 260 obtained in the initial state (immediately after manufacturing) scarcely needs to be adjusted in the color liquid crystal panel. The curve 261 after a lapse of time needs to be adjusted such that, in the color distribution of the light after transmitted by the color liquid crystal panel, the color difference against the light source position (x=0) is zero at each of the distances x. For example, when the blue color of the light incident on the color liquid crystal panel decreases as a result of the discoloration of the optical member due to aging and the light is changed into yellow, the microcomputer 125 performs adjustment such that the transmittance of the color liquid crystal panel with respect to the blue color is increased to compensate for the color change.

Figure 14A:
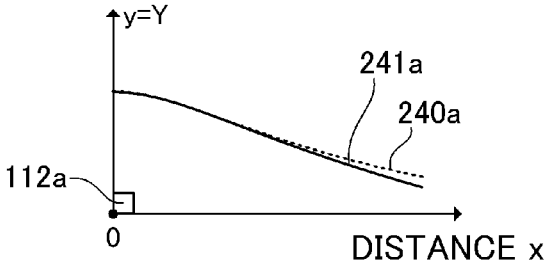
FIG. 14A to 14C are graphs of individual brightness distributions in the LED chips and a graph obtained by sum of the individual brightness distributions on each other.

FIG. 14A is a graph showing the change of the individual brightness distribution in the LED chip 112*a* due to lapse of time. FIG. 14A is equivalent to FIG. 9 and shows a curve 240*a* obtained in the initial state (immediately after manufacturing) and a curve 241*a* obtained after a lapse of time.

Figure 14B:
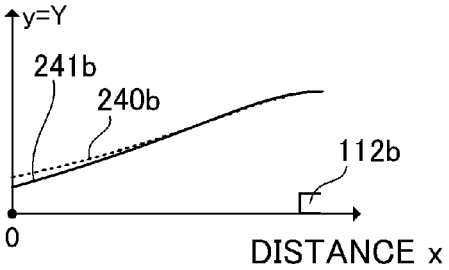

FIG. 14B is a graph showing the change of the individual brightness distribution in the LED chip 112*b* due to lapse of time. FIG. 14B is also equivalent to FIG. 9, but the position of the LED chip 112*b* is away at a given distance from x=0 serving as the reference point. FIG. 14B shows a curve 240*b* obtained in the initial state (immediately after manufacturing) and a curve 241*b* obtained after a lapse of time.

The microcomputer 125 obtains the brightness distribution of the light incident on the color liquid crystal panel by sum of the individual brightness distributions in all the light emitting units 111 on each other. Here, for the sake of simplicity, the case is shown where the brightness distribution of the light incident on the color liquid crystal panel is obtained by sum of the individual brightness distribution in the LED chip 112*a* in FIG. 14A and the individual brightness distribution in the LED chip 112*b* in FIG. 14B on each other.

Figure 14C:
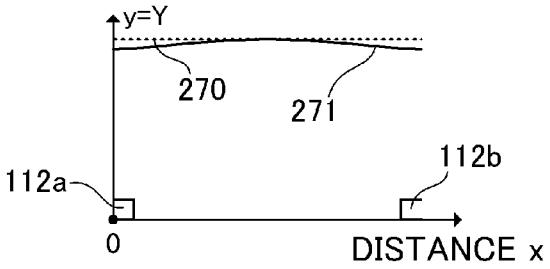

FIG. 14C is a graph showing the brightness distribution of the light incident on the color liquid crystal panel obtained by sum of the individual color distributions in the LED chips 112*a* and 112*b* on each other.

A curve 270 shows the brightness distribution of the light incident on the color liquid crystal panel in the initial state (immediately after manufacturing), which has been obtained by sum of the curves 240*a* and 240*b* in FIGS. 14A and 14B on each other. In each of the curves 240*a* and 240*b*, the brightness decreases with distance from the LED chip 112. However, it is assumed that, in a curve obtained by sum of the curves 240*a* and 240*b* on each other, the brightness scarcely changes irrespective of the distance x to provide a state free from unevenness, as in the curve 270.

A curve 271 shows the brightness distribution of the light incident on the color liquid crystal panel after a lapse of time, which has been obtained by sum of the curves 241*a* and 241*b* in FIGS. 14A and 14B on each other. In the individual brightness distribution after a lapse of time, the amount of decrease in brightness with the distance from the LED chip 112 is larger than in the curve obtained in the initial state (immediately after manufacturing). In the curve 271 obtained by sum of the curves 241*a* and 241*b* on each other, the brightness decreases with approach to the LED chips 112*a* and 112*b*, while having a peak at the middle point between the LED chips 112*a* and 112*b*.

The microcomputer 125 performs the process of adjusting the light transmittance of the color liquid crystal panel 105 in accordance with the brightness distribution of the light incident on the color liquid crystal panel 105 to reduce unevenness. The microcomputer 125 performs the process of correcting (adjusting) the transmittance of the liquid crystal panel so as to compensate for the difference between the curve 271 obtained after a lapse of time and the curve 270 in FIG. 14C obtained in the initial state.

The curve 270 obtained in the initial state need not be adjusted so that the microcomputer 125 does not particularly correct the image signal to be input to the color liquid crystal panel 105. On the other hand, to adjust the difference between the curve 271 obtained after a lapse of time and the curve 270, the microcomputer 125 performs adjustment on the color liquid crystal panel 105 such that the transmittance increases with approach to the LED chips 112*a* and 112*b*. As a result, in the brightness distribution (unevenness) of the light after transmitted by the color liquid crystal panel, the change due to lapse of time is reduced.

Using FIGS. 13 and 14, the unevenness reducing process performed using the liquid crystal panel has been described. However, the process in the liquid crystal panel and the process in the backlight device can also be performed in combination.

Figure 15:
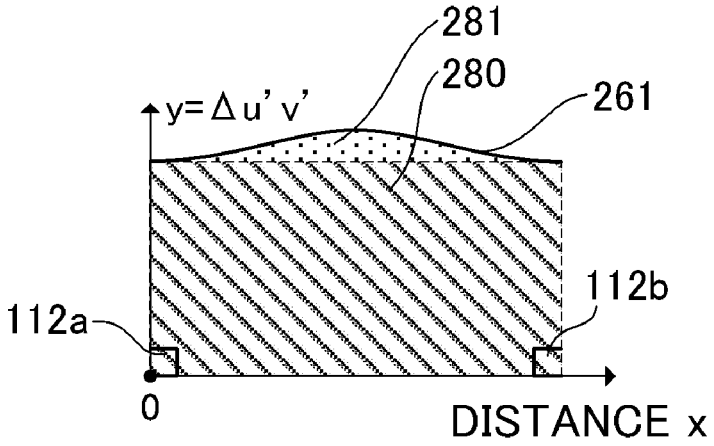
FIG. 15 is a conceptual view of an unevenness reducing process in which backlight emission control and image processing are combined.

FIG. 15 is a graph showing task assignment when the unevenness reducing process in accordance with the color distribution of the light incident on the color liquid crystal panel is performed by combining the process in the backlight device with the process in the liquid crystal panel.

A curve 261 shows the color distribution of the light incident on the color liquid crystal panel 105 after a lapse of time. As has been described above using FIG. 13, the microcomputer 125 adjusts the transmittance of the color liquid crystal panel 105 on the basis of the curve 261 such that, in the color distribution of the light after transmitted by the color liquid crystal panel, the color difference against the light source position (x=0) becomes zero at each of the distances x. Of the graph, the portion corresponding to an amount of adjustment 280 can uniformly be adjusted irrespective of the distance x. Accordingly, the microcomputer 125 performs the adjustment of the portion corresponding to the amount of adjustment 280 by adjusting the amount of emission from each of the light emitting units of the backlight. For example, in a backlight having a configuration including LED chips formed of RGB three-color LEDs, the brightness ratio among the RGB three-color LEDs is changed to allow the colors of the light emitted from the light emitting units to be adjusted. On the other hand, the portion of the graph corresponding to an amount of adjustment 281 needs to be adjusted in accordance with the distance x. Accordingly, the microcomputer 125 performs the adjustment of the portion corresponding to the amount of adjustment 281 by adjusting the transmittance of the color liquid crystal panel 105 on a per-pixel basis.

By thus applying Embodiment 1, even when discoloration, contamination, blur, or the like has occurred in the optical member forming the backlight device due to aging, the change of each of the individual brightness distribution and the individual color distribution can be detected and unevenness is sufficiently reduced.

Embodiment 2

A description will be given below of a light source device according to Embodiment 2 of the present invention. In Embodiment 1, one close optical sensor and one distant optical sensor are used. In Embodiment 2, a description will be given of an example of the case where a plurality of distant optical sensors is used. Note that the same members as used in Embodiment 1 are designated by the same reference numerals and a description thereof is omitted.

Figure 16:
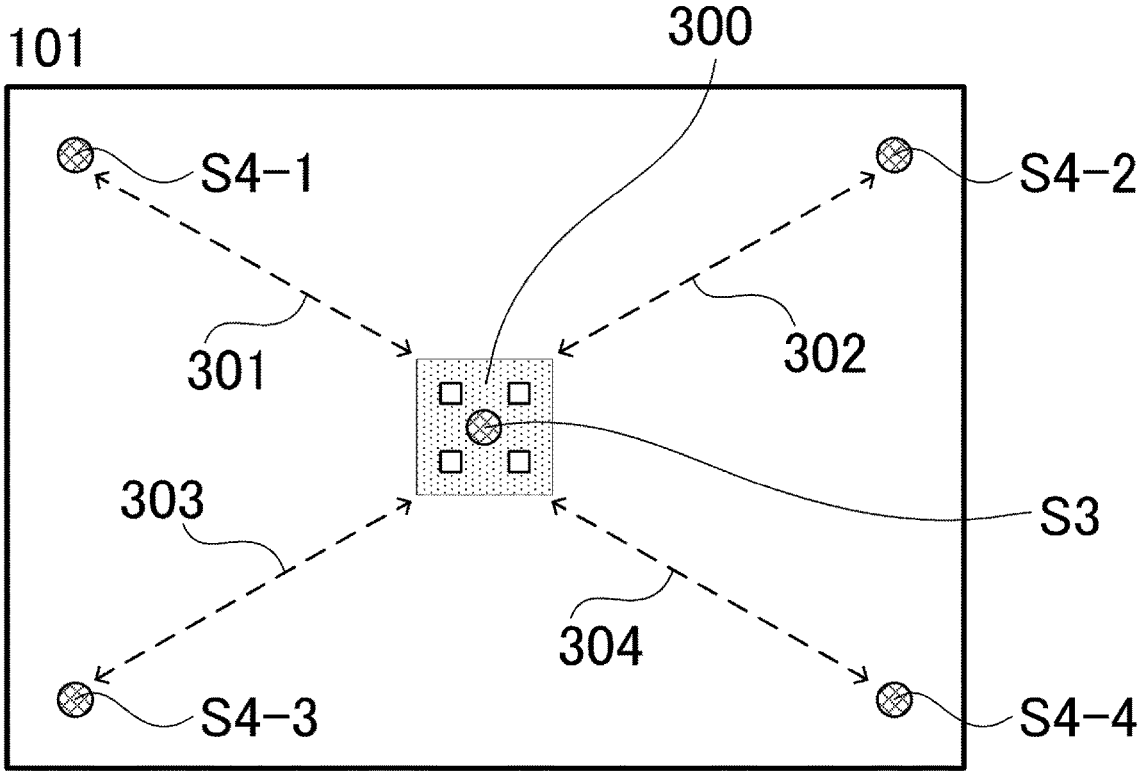
FIG. 16 is a schematic diagram showing the locations of a light emitting unit 300, a close optical sensor S3, and a distant optical sensor S4.

FIG. 16 is a schematic diagram showing the locations of a light emitting unit 300 used to detect the change of each of an individual brightness distribution and an individual color distribution, a close optical sensor S3, and distant optical sensors S4 when viewed in the front direction (from the color liquid crystal panel 105).

The microcomputer 125 uses, as the light emitting unit 300 used to detect the change of each of the individual brightness distribution and the individual color distribution, the light emitting unit 111(3,4) located at the center portion of the screen. The microcomputer 125 uses, as the close optical sensor S1, the optical sensor 113(3,4) provided in the light emitting unit 111(3,4).

The microcomputer 125 uses, as the distant optical sensor S4, the total four optical sensors which are the optical sensors 113(1,1), 113(1,7), 113(5,1) and 113(5,7). The four optical sensors 113 are at approximately equal distances 301, 302, 303, and 304 to the light emitting unit 300.

When the distances to the light emitting unit 300 are equal, the light detected by each of the distant optical sensors S4 has been reflected by the optical member an equal number of times. Accordingly, the fractional decrease rate $R_{YEL}$ due to the degradation of the optical member in the decrease rate R of the detection value after a lapse of time is also equal in each of the distant optical sensors S4.

The microcomputer 125 uses the sum of detection values from the total of four optical sensors 113 as a detection value from the distant optical sensor S4 and determines the fractional decrease rate $R_{YEL}$ from the difference between the decrease rate of the sum of the four detection values and the decrease rate of the detection value from the close optical sensor S1. Since the amount of light incident on the distant optical sensor is small, the detection value decreases to reduce an S/N ratio, which may result in a detection error. However, by using the sum of the plurality of detection values as in Embodiment 2, the situation is improved.

Next, a description will be given of another example of the case where the plurality of distant optical sensors is used.

Figure 17:
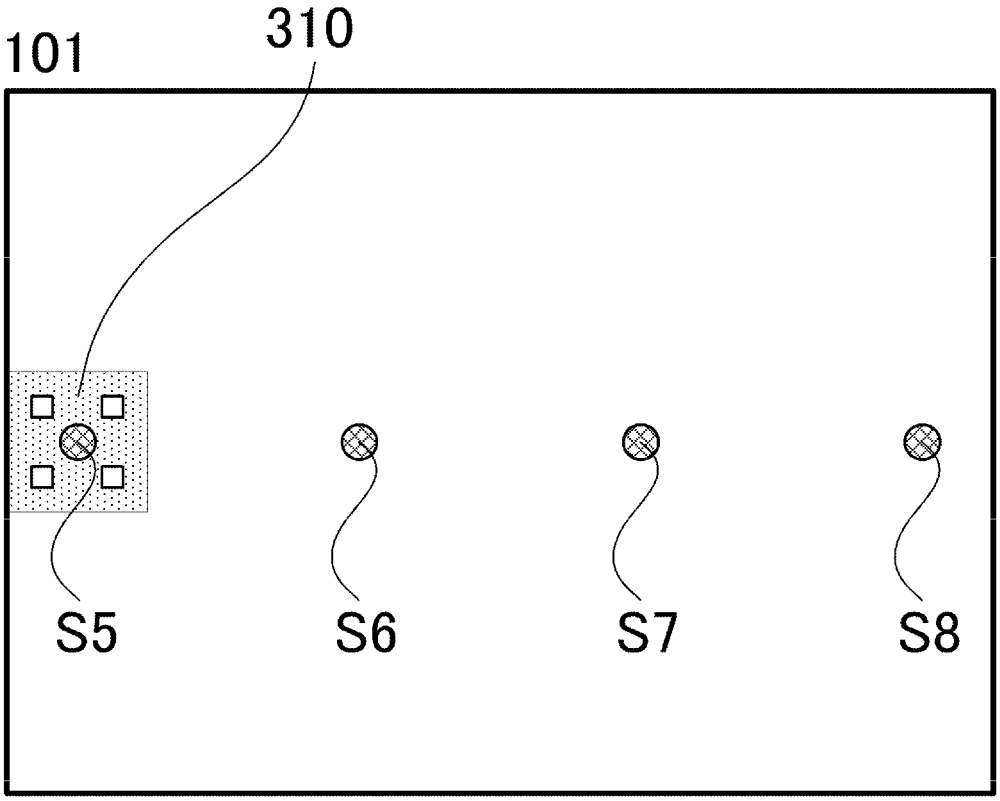
FIG. 17 is a schematic diagram showing the locations of a light emitting unit 310 and optical sensors S5 to S8.

FIG. 17 shows the locations of a light emitting unit 310 used to detect the change of each the individual brightness distribution and the individual color distribution, a closest optical sensor S5, a third-most-distant optical sensor S6, a second-most-distant optical sensor S7, and a most distant optical sensor S8 when viewed from the front direction (from the color liquid crystal panel 105).

The microcomputer 125 uses, as the light emitting unit 310 used to detect the change of each of the individual brightness distribution and the individual color distribution, the light emitting unit 111(3,1) located at the left end of the light source board 101. The microcomputer 125 uses, as the closest optical sensor S5, the optical sensor 113(3,1) provided in the light emitting unit 111(3,1).

The microcomputer 125 uses, as the distant optical sensor, the three optical sensors 113 at different distances to the light emitting unit 310. The microcomputer 125 uses the optical sensor 113(3,3) as the third-most-distant optical sensor S6, uses the optical sensor 113(3,5) as the second-most-distant optical sensor S7, and uses the optical sensor 113(3,7) as the most distant optical sensor S8.

Since the distances to the light emitting unit 310 are different, the number of times the light detected by each of the optical sensors 113 has been reflected by the optical member is also different. Accordingly, the fractional decrease rate $R_{YEL}$ due to the degradation of the optical member in the decrease rate R of the detection value after a lapse of time is also different in each of the optical sensors 113. By using this, the microcomputer 125 performs correction using the detection values from the third-most-distant optical sensor S6 and the second-most-distant optical sensor S7 to finally determine the fractional decrease rate $R_{YEL}$ in the most distant optical sensor S8.

Figure 18:
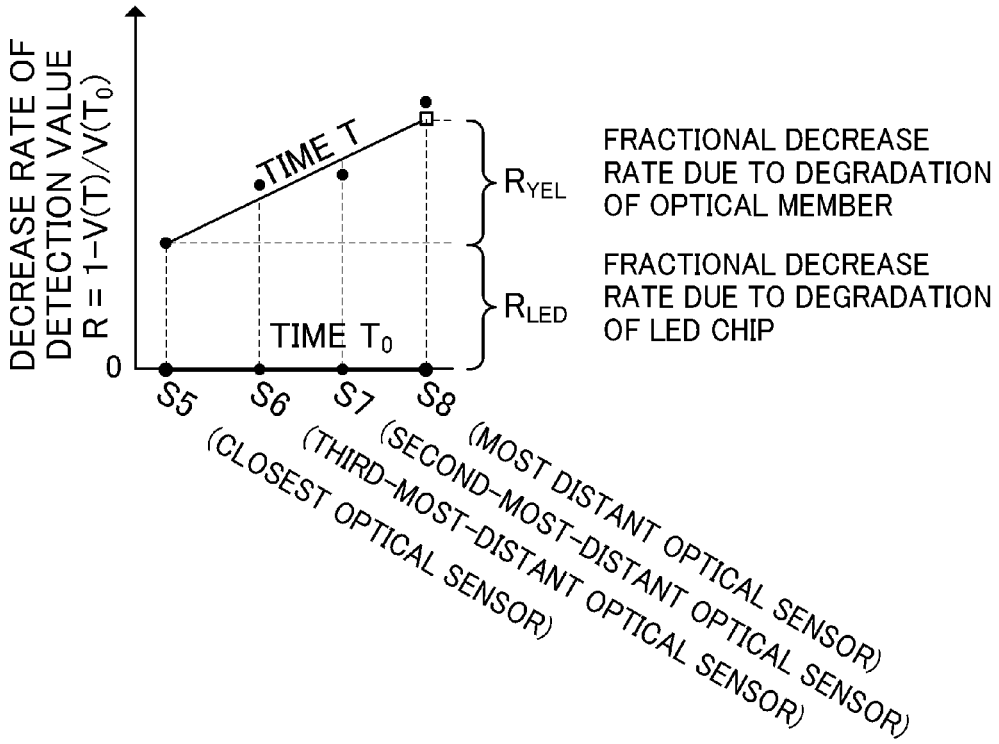
FIG. 18 is a graph showing the decrease rate R of each of detection values from the optical sensors S5 to S8.

FIG. 18 is a graph showing the decrease rates R in the closest optical sensor S5, the third-most-distant optical sensor S6, the second-most-distant optical sensor S7, and the most distant optical sensor S8. The detection value from the closest optical sensor S5 is immune to the influence of discoloration, contamination, blur, or the like in the optical member due to aging since the number of times the light has been reflected by the optical member is zero or small. Accordingly, the closest optical sensor S5 mainly detects a brightness decrease due to the aging degradation of the LED chip 112.

The detection value from the most distant sensor S8 is affected by aging since the light has been reflected by the optical member a considerable number of times. The detection value from the second-most-distant-sensor S7 is less affected by aging than the detection value from the most distant optical sensor S8. The detection value from the third-most-distant optical sensor S6 is less affected by aging than the detection value from the second-most-distant optical sensor S7.

In the accelerated deterioration test performed in advance, the ratio among the fractional decrease rates $R_{YEL}$ due to the degradation of the optical member in the most distant optical sensor S8, the second-most-distant optical sensor S7, and the third-most-distant optical sensor S6 is preliminarily evaluated. For example, it is assumed that, in the accelerated deterioration test, the ratio thereamong is $R_{YEL/S8}:R_{YEL/S7}:R_{YEL/S6}=3:2:1$. Information on the fractional decrease rates in the individual optical sensors obtained in the test is stored in the nonvolatile memory 126.

In the color image display apparatus used by the user, to determine the fractional decrease rate $R_{YEL/S8}$ in the most distant optical sensor S8, the microcomputer 125 acquires, from the nonvolatile memory 126, the information obtained in the foregoing accelerated deterioration test. Then, the microcomputer 125 determines the ratio among the fractional decrease rates in the individual optical sensors and corrects the fractional decrease rate $R_{YEL/S8}$ in the most distant optical sensor S8. This improves the accuracy of detection of the change of each of the individual brightness distribution and the individual color distribution. For example, it is assumed that, in the color image display apparatus used by the user, the microcomputer 125 has detected the fractional decrease rates at the ratio of $R_{YEL/S8}:R_{YEL/S7}:R_{YEL/S6}=3.1:2:1$. Since the detected fractional decrease rate $R_{YEL/S8}$ is slightly higher than in the data stored in the nonvolatile memory 126, the microcomputer 125 performs correction which slightly reduces the factional decrease rate $R_{YEL/S8}$.

Thus, even when the plurality of distant optical sensors are used as in Embodiment 2 and discoloration, contamination, blur, or the like has occurred in the optical member forming the backlight device due to aging, the change of each of the individual brightness distribution and the individual color distribution is detected and unevenness is sufficiently reduced.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to readout and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-075651, filed on Apr. 1, 2014, which is hereby incorporated by reference herein in its entirety.

What is claimed is:

1. A display apparatus, comprising:

a light source;

a display panel that displays an image by controlling a transmittance of light from the light source;

a first sensor that detects a brightness of the light source;

a second sensor that detects a brightness of the light source, a distance from the light source to the second sensor being longer than a distance from the light source to the first sensor;

a memory that stores correspondence information indicating a predetermined correspondence relationship of a difference between a first change degree of a detection value from the first sensor and a second change degree of a detection value from the second sensor with a change in a brightness distribution or a color distribution in the display sand due to the light from the light source; and a controller configured to control a transmittance of the display panel, wherein the controller performs:

acquiring the change in the brightness distribution or the color distribution in the display panel due to light from the light source during a period on the basis of the first change degree during the period, the second change degree during the period aid the correspondence information stored in the memory; and controlling the transmittance of the display panel on the basis of the change in the brightness distribution or the color distribution during the period.

2. The display apparatus according to claim 1, wherein the correspondence information indicates a predetermined correspondence relationship between the difference and a change the brightness distribution in the display panel due to the light from the light source, and the controller performs:

acquiring the change in the brightness distribution in the display panel due to light from the light source during the period on the basis of the first change degree during the period, the second change degree during the period and the correspondence information; and controlling the transmittance of the display panel so as to compensate for the change in the brightness distribution.

3. The display apparatus according to claim 1, wherein the controller performs controlling an amount of the light emitted from front the light source so as to compensate for the change in the brightness distribution or the color distribution.

4. The display apparatus according to claim 1, wherein the correspondence information indicates a predetermined correspondence relationship between the difference and a change in the color distribution in the display panel due to the light from the light source, and the controller performs:

acquiring the change in the color distribution in the display panel due to light from the light source during the period on the basis of the first change degree during the period, the second change degree during the period and the correspondence information; and controlling the transmittance of the display panel so as to compensate for the change in the color distribution.

5. The display apparatus according to claim 1, further comprising:

a plurality of optical sensors including the first and second sensors, wherein the first sensor is the optical sensor at a position closest to the light source among the plurality of optical sensors.

6. The display apparatus according to claim 1, further comprising:

a plurality of optical sensors including the first and second sensors, wherein the second sensor is the optical sensor at a position most distant from the light source among the plurality of optical sensors.

7. The display apparatus according to claim 1, wherein the second sensor consists of a plurality of optical sensors at approximately equal distances from the light source, and each of respective distances from the light source to the respective optical sensors is longer than a distance from the light source to the first sensor, and the controller acquires, as the detection value from the second sensor, a sum of detection values from the plurality of optical sensors.

8. The display apparatus according to claim 1, further comprising a plurality of the light sources, wherein the controller performs acquiring the detection value from the first sensor and the detection value from the second sensor in a state where one of the plurality of light sources has been turned on and other light sources of the plurality of light sources have been turned off.

9. The display apparatus according to claim 8, wherein the one of the plurality of light sources is located at a position corresponding to a center portion of the display panel.

10. The display apparatus according to claim 1, wherein the first change degree is a decrease rate of the detection value from the first sensor and the second change degree is a decrease rate of the detection value from the second sensor.

11. A display apparatus, comprising:

a light source;

a display panel that displays an image by controlling a transmittance of light from the light source;

a first sensor that detects a brightness of the light source;

a second sensor that detects a brightness of the light source, the second sensor consisting of a plurality of optical sensors at different distances from the light source, and each of respective distances from the light source to the respective optical sensors being longer than a distance from the light source to the first sensor, a memory that stores change degree information indicating respective predetermined change degrees of detection values from the respective optical sensors of the second sensor; and a controller that controls a transmittance of the display panel wherein the controller performs:

acquiring the change degree of the detection value from any of the plurality of optical sensors during a period, correcting the change degree on the basis of the change degree information, and controlling the transmittance of the display panel on the basis of a difference between the corrected change degree and a change degree of a detection value from the first sensor during the period.

12. A method of controlling a display apparatus including: a light source; a display panel that displays an image by controlling a transmittance of light from the light source; a first sensor that detects a brightness of the light source; and a second sensor that detects a brightness of the light source, a distance from the light source to the second sensor being longer than a distance from the light source to the first sensor, the method comprising:

acquiring correspondence information indicating a predetermined correspondence relationship of a difference between a first change degree of a detection value from the first sensor and a second change degree of a detection value from the second sensor with a change in a brightness distribution or a color distribution in the display panel due to the light from the light source;

acquiring the change in the brightness distribution or the color distribution in the display panel due to the light from the light source during a period on the basis of the first change degree during the period, the second change degree during the period and the correspondence information stored in the memory; and controlling the transmittance of the display panel on the basis of the change in the brightness distribution or the color distribution during the period.

13. A display apparatus, comprising:

a light source configured to emit light in a front direction;

an optical member configured to diffuse a part of the light from the light source in a direction perpendicular to the front direction;

a display panel configured to display an image by transmitting the light from the light source;

a first sensor provided in neighbor of the light source to detect a brightness of the light source;

a second sensor to detect a brightness of the light source, a distance from the light source to the second sensor being longer than a distance from the light source to the first sensor; and a controller configured to control a transmittance of the display panel, wherein the controller performs acquiring a degree of a degradation of the optical member on the basis of a detection value of the first sensor and a detection value of the second sensor, and controlling the transmittance of the display panel on the basis of the degree of the degradation of the optical member.

14. A method of controlling a display apparatus including: a light source; a display panel that displays an image by controlling a transmittance of light from the light source; a first sensor that detects a brightness of the light source; and a second sensor that detects a brightness of the light source, the second sensor consisting of a plurality of optical sensors at different distances from the light source, and each of respective distances from the light source to the respective optical sensors being longer than a distance from the light source to the first sensor, the method comprising:

acquiring change degree information indicating respective predetermined change degrees of detection values from the respective optical sensors of the second sensor;

acquiring the change degree of the detection value from any of the plurality of optical sensors during a period;

correcting the change degree on the basis of the change degree information; and controlling the transmittance of the display panel on the basis of a difference between the corrected change degree and a change degree of a detection value from the first sensor during the period.

15. A method of controlling a display apparatus including:

a light source configured to emit light in a front direction;

an optical member configured to diffuse a part of the light from the light source in a direction that is perpendicular to the front direction;

a display panel configured to display an image by transmitting the light from the light source;

a first sensor provided in neighbor of the light source to detect a brightness of the light source; and a second sensor to detect a brightness of the light source, a distance from the light source to the second sensor being longer than a distance from the light source to the first sensor; the method comprising:

acquiring a degree of a degradation of the optical member on the basis of a detection value of the first sensor and a detection value of the second sensor, and controlling a transmittance of the display panel on the basis of the degree of the degradation of the optical member.

* * * * *